US012590349B2

(12) United States Patent
Choi et al.

(10) Patent No.: US 12,590,349 B2
(45) Date of Patent: Mar. 31, 2026

(54) HIGH-STRENGTH HOT-DIP GALVANIZED STEEL SHEET WITH HIGH DUCTILITY AND EXCELLENT FORMABILITY, AND MANUFACTURING METHOD FOR SAME

(71) Applicant: POSCO CO., LTD, Pohang-si (KR)

(72) Inventors: Kang-Hyun Choi, Gwangyang-si (KR); Yeon-Sang Ahn, Gwangyang-si (KR); Joo-Hyun Ryu, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 299 days.

(21) Appl. No.: 18/265,246

(22) PCT Filed: Nov. 15, 2021

(86) PCT No.: PCT/KR2021/016592
§ 371 (c)(1),
(2) Date: Jun. 2, 2023

(87) PCT Pub. No.: WO2022/124609
PCT Pub. Date: Jun. 16, 2022

(65) Prior Publication Data

US 2024/0026483 A1 Jan. 25, 2024

(30) Foreign Application Priority Data

Dec. 9, 2020 (KR) ..... 10-2020-0171101

(51) Int. Cl.
*C22C 38/00* (2006.01)
*C21D 1/18* (2006.01)
(Continued)

(52) U.S. Cl.
CPC ..... *C21D 9/46* (2013.01); *C21D 1/18* (2013.01); *C21D 1/84* (2013.01); *C21D 6/002* (2013.01);
(Continued)

(58) Field of Classification Search
CPC ..... C21D 6/002; C21D 6/005; C21D 6/008; C21D 8/0226; C21D 8/0236;
(Continued)

(56) References Cited

U.S. PATENT DOCUMENTS 11,332,803 B2 * 5/2022 Yokoyama ..... C21D 6/008
2013/0295410 A1 11/2013 Takahashi et al.
(Continued)

FOREIGN PATENT DOCUMENTS

EP 3859041 A1 8/2021
JP 2004018971 1/2004
(Continued)

OTHER PUBLICATIONS

English translation of JP6750772 as obtained form EPO espacenet May 31, 2025 (Year: 2025).*
(Continued)

*Primary Examiner* — Adam Krupicka
(74) *Attorney, Agent, or Firm* — CANTOR COLBURN LLP

(57) ABSTRACT

Provided is a high-strength hot-dip galvanized steel sheet having excellent ductility and formability. The hot-dip galvanized steel sheet contains, by wt %, 0.06 to 0.16% of carbon (C), 0.8% or less (excluding 0%) of silicon (Si), 2.1 to 2.7% of manganese (Mn), 0.4% or less (excluding 0%) of molybdenum (Mo), 1% or less (excluding 0%) of chromium (Cr), 0.1% or less (excluding 0%) of phosphorus (P), 0.02% or less of sulfur (S), 1% or less (excluding 0%) of aluminum (sol.Al), 0.001 to 0.04% of titanium (Ti), 0.001 to 0.04% of niobium (Nb), 0.01% or less (excluding 0%) of nitrogen (N), 0.01% or less of boron (B), 0.05% or less of antimony (Sb), and a balance of Fe and unavoidable impurities.

5 Claims, 3 Drawing Sheets

(51) Int. Cl.

| | |
|---|---|
| ***C21D 1/84*** | (2006.01) |
| ***C21D 6/00*** | (2006.01) |
| ***C21D 8/02*** | (2006.01) |
| ***C21D 8/0221*** | (2026.01) |
| ***C21D 8/0247*** | (2026.01) |
| ***C21D 8/0278*** | (2026.01) |
| ***C21D 9/46*** | (2006.01) |
| ***C22C 38/02*** | (2006.01) |
| ***C22C 38/06*** | (2006.01) |
| ***C22C 38/22*** | (2006.01) |
| ***C22C 38/26*** | (2006.01) |
| ***C22C 38/32*** | (2006.01) |
| ***C22C 38/38*** | (2006.01) |
| ***C22C 38/60*** | (2006.01) |
| ***C23C 2/28*** | (2006.01) |

(52) U.S. Cl.
CPC ..... *C21D 6/005* (2013.01); *C21D 6/008* (2013.01); *C21D 8/0205* (2013.01); *C21D 8/0226* (2013.01); *C21D 8/0236* (2013.01); *C21D 8/0263* (2013.01); *C21D 8/0278* (2013.01); *C22C 38/002* (2013.01); *C22C 38/02* (2013.01); *C22C 38/06* (2013.01); *C22C 38/22* (2013.01); *C22C 38/26* (2013.01); *C22C 38/32* (2013.01); *C22C 38/38* (2013.01); *C22C 38/60* (2013.01); *C23C 2/28* (2013.01); *C23C 2/29* (2022.08); *C21D 2211/001* (2013.01); *C21D 2211/002* (2013.01); *C21D 2211/005* (2013.01); *C21D 2211/008* (2013.01)

(58) Field of Classification Search
CPC . C21D 2211/008; C22C 38/001; C22C 38/04; C22C 38/06; C22C 38/22; C22C 38/26; C22C 38/28
See application file for complete search history.

(56) References Cited

U.S. PATENT DOCUMENTS

| | | | |
|---|---|---|---|
| 2014/0212684 | A1 | 7/2014 | Kawata et al. |
| 2018/0202016 | A1 | 7/2018 | Yokoyama et al. |
| 2020/0024709 | A1 | 1/2020 | Yokoyama et al. |
| 2020/0115771 | A1 | 4/2020 | Yokoyama et al. |
| 2020/0165708 | A1 | 5/2020 | Hasegawa et al. |
| 2020/0190612 | A1 | 6/2020 | Kwak et al. |
| 2020/0190640 | A1 | 6/2020 | Seo et al. |
| 2020/0347476 | A1 | 11/2020 | Ahn et al. |
| 2021/0230712 | A1 | 7/2021 | Yokoyama et al. |
| 2022/0090248 | A1 | 3/2022 | Yokoyama et al. |
| 2022/0119908 | A1 | 4/2022 | Yokoyama et al. |

FOREIGN PATENT DOCUMENTS

| | | | | |
|---|---|---|---|---|
| JP | 2009518541 | A | 5/2009 | |
| JP | 2010090432 | | 4/2010 | |
| JP | 2012117148 | | 6/2012 | |
| JP | 2013234340 | | 11/2013 | |
| JP | 6645636 | | 2/2020 | |
| JP | 6750772 | B1 | 8/2020 | |
| JP | 6777274 | | 10/2020 | |
| KR | 101597473 | | 2/2016 | |
| KR | 101858852 | | 6/2018 | |
| KR | 20190076307 | | 7/2019 | |
| KR | 20190133739 | | 12/2019 | |
| KR | 20200036759 | A | 4/2020 | |
| KR | 20200075991 | | 6/2020 | |
| WO | 2007067014 | A1 | 6/2007 | |
| WO | 2017002883 | A1 | 1/2017 | |
| WO | 2017138384 | A1 | 8/2017 | |
| WO | 2018179386 | A1 | 10/2018 | |
| WO | WO-2018193787 | A1 * | 10/2018 | ..... C23C 2/40 |

OTHER PUBLICATIONS

Japanese Office Action—Japanese Application No. 2023-534273 issued on Aug. 20, 2024, citing WO 2018/193787, WO 2017/138384, WO 2017/002883, WO 2018/179386, and JP 2009-518541.
International Search Report—PCT/KR2021/016592 dated Feb. 16, 2022.
European Search Report—European Application No. 21903656.3 issued on Apr. 15, 2024, citing JP 6750772, US 2020/0115771, and KR 10-2020-0036759.

* cited by examiner

HIGH-STRENGTH HOT-DIP GALVANIZED STEEL SHEET WITH HIGH DUCTILITY AND EXCELLENT FORMABILITY, AND MANUFACTURING METHOD FOR SAME

TECHNICAL FIELD

The present disclosure relates to manufacturing of a high-strength hot-dip galvanized steel sheet mainly used for an automotive structural member and has a tensile strength of 980 MPa or more, and more particularly, to a hot-dip galvanized steel sheet having excellent ductility and formability satisfying a relational expression YS×EL between yield strength (YS) and elongation (EL) of 9,000 or more and has a yield ratio (YS/TS) of 0.65 or more, and a method for manufacturing the same.

BACKGROUND ART

Recently, regulations for the preservation of the global environment in the automobile industry have been gradually strengthened. Accordingly, regulations for fuel efficiency have been strengthened, and the use of a lightweight and high-strength steel sheet has been required in order to respond thereto. In addition, crashworthiness regulations for occupant protection have also been expanded, and in order to improve impact resistance of an automotive body, high-strength steel having an excellent yield strength has been applied for structural members such as a member, a seat rail, and a pillar. However, strengthening of the steel sheet may cause a reduction in ductility and formability. In order to solve this problem, the development of a material satisfying both high strength and high formability has been demanded. In general, as the strength of the steel sheet is increased, elongation is decreased, which causes a reduction in workability. Therefore, there is demand for the development of a material capable of supplementing this problem. Usually, as a method for strengthening steel, solid solution strengthening, precipitation strengthening, strengthening by grain refinement, transformation strengthening, and the like have been researched. However, steel materials obtained by using solid solution strengthening and grain refinement among the above methods have a problem in that it is significantly difficult to manufacture high-strength steel having a tensile strength of 490 MPa or more.

Meanwhile, precipitation-strengthened high-strength steel is a technique to secure strength by precipitating carbonitrides through addition of carbonitride forming elements such as Nb, Ti, and V and refining grains through grain growth inhibition by fine precipitates. The above technique has an advantage that high strength may be easily obtained compared to a low manufacturing cost, but has a disadvantage that high-temperature annealing should be performed in order to secure ductility through sufficient recrystallization because a recrystallization temperature is rapidly increased due to the fine precipitates. In addition, in the case of the precipitation-strengthened steel that is strengthened by precipitating carbonitrides in a ferrite matrix, it is difficult to obtain high-strength steel with 600 MPa or more.

Meanwhile, as transformation-strengthened high-strength steel, various types of steel such as dual-phase (DP) steel composed of a dual phase of a soft ferrite matrix and hard martensite, transformation induced plasticity (TRIP) steel with high ductility by using transformation-induced plasticity of retained austenite, and complexed phase steel composed of a complexed phase of ferrite and hard bainite or martensite have been developed. Recently, as an automotive steel sheet, a steel sheet having higher strength has been demanded to improve fuel efficiency or durability, and a demand for a high-strength steel sheet having a tensile strength of 780 to 980 MPa or more has been increasingly used for an automotive body structure or a reinforcing material in terms of crashworthiness and occupant protection. Thereamong, DP steel has excellent ductility and is the most commonly used automotive steel sheet, but has a low yield ratio (YR) and poor formability and workability. Moreover, in accordance with an increase in strength of the steel sheet, cracks or wrinkles occur during press forming of automotive parts, making it difficult to manufacture complex parts. In the case of TRIP steel, workability is superior to that of DP steel because it has an excellent yield ratio, but has poor weldability because a large amount of Si and Al is added in order to secure a high elongation.

In order to overcome the disadvantages of these existing DP steels, a steel material satisfying a yield ratio above a certain level while securing high ductility of the existing DP steel through a careful heat treatment is manufactured, such that high-steel steel may be extended to more complex parts. This may be achieved by utilizing a quenching and partitioning (Q&P) heat treatment as the latest heat treatment technique through which retained austenite may be secured.

An example of the related art for securing both ductility and workability of the high-strength steel sheet includes the invention disclosed in Patent Document 1. In the above technique, fresh martensite (FM) is formed in the final cooling operation due to the presence of a significant amount of austenite that is not stabilized according to a Q&P temperature. A content of carbon in fresh martensite is high, which causes a decrease in a hole expansion ratio. Therefore, a heat treatment temperature should be carefully selected.

Another example of the related art includes the invention disclosed in Patent Document 2. The above technique provides a method for manufacturing a cold-rolled steel sheet that obtains both high strength and high ductility by utilizing tempered martensite formed in a quenching heat treatment and has an excellent sheet shape even after continuous annealing. However, the above technique has a problem in that weldability is reduced because a content of carbon is 0.2% or more, which is high, and dents in a furnace may occur during annealing because the amount of Si added is 1.0% or more, which is high.

In addition, the invention according to the related art disclosed in Patent Document 3 provides a method for manufacturing a high-strength cold-rolled steel sheet having an excellent hole expansion ratio by quenching and reheating, and in this case, dents in a furnace may occur because the amount of Si added is 1.3% or more, which is also high.

RELATED ART DOCUMENTS

Patent Documents (Patent Document 1) Japanese Patent Laid-Open Publication No. 2002-177278

(Patent Document 2) Japanese Patent Laid-Open Publication No. 2010-090432

(Patent Document 3) Korean Patent Laid-open Publication No. 2016-0173006

DISCLOSURE

Technical Problem

An aspect of the present disclosure is to provide a hot-dip galvanized steel sheet having excellent ductility and formability satisfying a relational expression YS×EL between yield strength (YS) and elongation (EL) of 9,000 or more, has a yield ratio (YS/TS) of 0.65 or more, and is used for an automotive structural member, and a method for manufacturing the same.

Meanwhile, an object of the present disclosure is not limited to the above description. The object of the present disclosure will be understood from the general contents of the present specification, and those skilled in the art to which the present disclosure pertains will have no difficulties in understanding the additional objects of the present disclosure.

Technical Solution

According to an aspect of the present disclosure, a hot-dip galvanized steel sheet having excellent ductility and formability contains, by wt %, 0.06 to 0.16% of carbon (C), 0.8% or less (excluding 0%) of silicon (Si), 2.1 to 2.7% of manganese (Mn), 0.4% or less (excluding 0%) of molybdenum (Mo), 1% or less (excluding 0%) of chromium (Cr), 0.1% or less (excluding 0%) of phosphorus (P), 0.02% or less of sulfur (S), 1% or less (excluding 0%) of aluminum (sol.Al), 0.001 to 0.04% of titanium (Ti), 0.001 to 0.04% of niobium (Nb), 0.01% or less (excluding 0%) of nitrogen (N), 0.01% or less of boron (B), 0.05% or less of antimony (Sb), and a balance of Fe and unavoidable impurities, wherein the components of C, Si, Al, Mn, Cr, Mo, and B among the base steel components in a matrix structure at a ¼t point of a thickness of a base steel sheet satisfy the following Relational Expression 1, and a microstructure in the base steel sheet contains, by area %, 70% or more of a sum of bainite and tempered martensite, 10% or less of ferrite, and a balance of fresh martensite and retained austenite, and a fraction of the retained austenite is 5% or less in terms of area %, $$(4\times C+Si+Al)/(Mn+Cr+5\times Mo+200\times B)\leq 0.35. \quad \text{[Relational Expression 1]}$$

The hot-dip galvanized steel sheet may have a hole expansion ratio (HER) of 30% or more, may satisfy a relational expression YS×EL between yield strength (YS) and elongation (EL) of 9,000 or more, and may have a yield ratio (YS/TS) of 0.65 or more.

According to another aspect of the present disclosure, a method for manufacturing a hot-dip galvanized steel sheet having excellent ductility and formability includes:

preparing a steel slab satisfying the composition component and Relational Expression 1 and then reheating the steel slab;

subjecting the reheated slab to hot rolling so that a finish rolling end temperature is Ar3 to Ar3+50° C., coiling the hot-rolled steel sheet at 400 to 650° C., and then cooling the coiled hot-rolled steel sheet to room temperature at an average cooling rate of 0.1° C. or lower;

subjecting the cooled hot-rolled steel sheet to cold rolling at a reduction ratio of 40 to 70% to manufacture a cold-rolled steel sheet;

continuously annealing the cold-rolled steel sheet at a temperature of 820 to 860° C.;

primarily cooling the continuously annealed steel sheet to a temperature within a range of 630 to 680° C. at an average cooling rate of 10° C. or lower, secondarily cooling the primarily cooled steel sheet to a temperature of 300 to 350° C. at an average cooling rate of 5° C. or higher using hydrogen gas, reheating the secondarily cooled steel sheet to a temperature of 400 to 480° C., and then maintaining the reheated steel sheet for 60 seconds or longer; and subjecting the maintained steel sheet to hot-dip galvanizing at a temperature of 400 to 450° C. and then cooling the hot-dip galvanized steel sheet to a temperature of Ms to 100° C. or lower at an average cooling rate of 5° C. or higher.

A microstructure in the hot-dip galvanized steel sheet may contain, by area %, 70% or more of a sum of bainite and tempered martensite, 10% or less of ferrite, and a balance of fresh martensite and retained austenite, and a fraction of the retained austenite may be 5% or less in terms of area %.

The method for manufacturing a hot-dip galvanized steel sheet having excellent ductility and formability may further include subjecting the manufactured hot-dip galvanized steel sheet to an alloying heat treatment.

Advantageous Effects

As set forth above, the present disclosure has a useful effect in manufacturing a high-strength hot-dip galvanized steel sheet satisfying high ductility, which is a property of DP steel, and having an excellent yield ratio (YS/TS) compared to DP steel according to the related art by optimizing components and a manufacturing process. Therefore, processing defects such as cracks generated in press forming are prevented, such that the high-strength hot-dip galvanized steel may be used in various ways for automotive structural members having complex shapes that require high formability, and may secure material and plating properties at the same time.

BEST MODE FOR INVENTION

Figure 1:
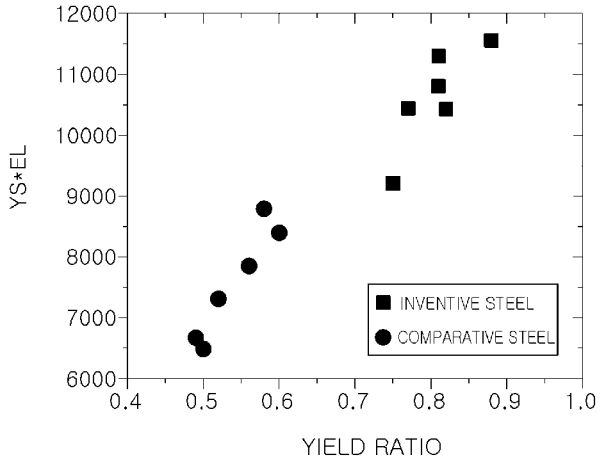
FIG. 1 is a view illustrating a change in relational expression YS×EL between yield strength (YS) and elongation (EL) according to a yield ratio (YS/TS) in an exemplary embodiment in the present disclosure.

Hereinafter, the present disclosure will be described.

The present inventors have found that when the steel composition component and manufacturing process are optimized, and retained austenite, ferrite, bainite, and fresh martensite are introduced into a final microstructure, a yield ratio may be increased compared to DP steel according to the related art, such that workability may be improved. In addition, the present inventors have found through experiments that such a microstructural change has the effect of improving ductility by delaying formation, growth, and combination of voids that cause ductile fracture through relieving a concentration of local stress and strain after necking, and furthermore, the ductility may be further improved due to formation of 5% or less of retained austenite during final cooling, and then completed the prevent disclosure based on the experimental results.

That is, in the present disclosure, a fraction of ferrite and martensite is reduced compared to the existing DP steel and retained austenite and bainite are introduced, such that a yield ratio may be increased compared to the existing DP steel, and thus workability may be secured. In addition, a large amount of mobile dislocations are formed around retained austenite during plastic deformation to help improve ductility. Such a precisely controlled complexed phase steel may secure ductility while maintaining a higher yield ratio than the existing DP steel. Through this, it is possible to manufacture a high-strength hot-dip galvanized steel sheet having excellent ductility and workability.

A hot-dip galvanized steel sheet having excellent ductility and formability of the present disclosure contains, by wt %, 0.06 to 0.16% of carbon (C), 0.8% or less (excluding 0%) of silicon (Si), 2.1 to 2.7% of manganese (Mn), 0.4% or less (excluding 0%) of molybdenum (Mo), 1% or less (excluding 0%) of chromium (Cr), 0.1% or less (excluding 0%) of phosphorus (P), 0.02% or less of sulfur (S), 1% or less (excluding 0%) of aluminum (sol.Al), 0.001 to 0.04% of titanium (Ti), 0.001 to 0.04% of niobium (Nb), 0.01% or less (excluding 0%) of nitrogen (N), 0.01% or less of boron (B), or less of antimony (Sb), and a balance of Fe and unavoidable impurities, wherein the components of C, Si, Al, Mn, Cr, Mo, and B among the base steel components in a matrix structure at a ¼t point of a thickness of a base steel sheet satisfy the following Relational Expression 1, and a microstructure in the base steel sheet contains, by area %, 70% or more of a sum of bainite and tempered martensite, 10% or less of ferrite, and a balance of fresh martensite and retained austenite, and a fraction of the retained austenite is 5% or less in terms of area %.

Hereinafter, first, the reason for limiting the alloy composition component and its content of the base steel sheet constituting the hot-dip galvanized steel sheet of the present disclosure will be described. Here, "%" represents wt % unless otherwise specified.

C: 0.06 to 0.16%

Carbon (C) is an important element added to strengthen a transformed structure. Carbon accelerates formation of hard martensite in complexed phase steel to improve strength. As a content of carbon is increased, the amount of martensite is increased. However, when the content of carbon exceeds strength of martensite is increased, but a difference in strength from ferrite having a low concentration of carbon is increased. Since fracturing easily occurs at an interface between phases during plastic deformation due to the difference in strength, ductility and a strain hardening rate are reduced. In addition, weldability is reduced, which causes welding defects in processing of parts of customers. On the other hand, when the content of carbon is less than 0.06%, it may be difficult to secure desired strength.

Therefore, in consideration of this, in the present disclosure, it is preferable to limit the content of carbon to a range of 0.06 to 0.16%, and it is more preferable to control the content of carbon to a range of 0.07 to 0.15%.

Si: 0.8% or Less (Excluding 0%)

Silicon (Si) is a ferrite stabilizing element, and is an element that contributes to formation of retained austenite by accelerating ferrite transformation and promoting carbon enrichment in untransformed austenite during a Q&P process. In addition, Si is effective in reducing the difference in hardness between phases by increasing strength of ferrite through solid solution strengthening, and is a useful element capable of securing strength without a reduction in ductility of a steel sheet. However, when a content of Si exceeds 0.8%, surface scale defects occur, which adversely affects plating surface quality and also causes a reduction in weldability and chemical conversion coating property. Therefore, an upper limit of the amount of Si added is limited to 0.8%. More preferably, the content of Si is controlled to 0.7% or less.

Mn: 2.1 to 2.7%

Manganese (Mn) is an element that refines particles without a reduction in ductility, completely precipitates sulfur (S) in steel as MnS, prevents hot brittleness caused by generation of FeS, and strengthens steel. At the same time, Mn serves to lower a critical cooling rate at which a martensite phase is obtained in complexed phase steel, which facilitates formation of martensite. When a content of Mn is less than 2.1%, it is difficult to secure the strength targeted in the present disclosure. On the other hand, when the content of Mn exceeds 2.7%, problems with weldability, hot rolling properties, and the like are likely to occur, the material is unstable due to formation of an excessive amount of martensite, and a risk of processing cracks and sheet rupture is increased due to formation of Mn-Band (Mn oxide band) in the structure. In addition, Mn oxides are eluted on a surface during annealing, which greatly deteriorates plating properties. Therefore, in the present disclosure, it is preferable to limit the content of Mn to 2.1 to 2.7%, and it is more preferable to control the content of Mn to a range of 2.3 to 2.5%.

Mo: 0.4% or Less (Excluding 0%)

Molybdenum (Mo) is an element that delays transformation of austenite into pearlite and improves refinement and strength of ferrite. Mo has advantages of improving hardenability of steel and being capable of controlling a yield ratio by finely forming martensite at grain boundaries. However, since Mo is an expensive element, as a content of Mo is increased, a manufacturing cost is increased, which is disadvantageous in terms of cost price. Therefore, it is preferable to appropriately control the content of Mo. In order to obtain the above effect, Mo is preferably added at a maximum of 0.4%. When the content of Mo exceeds 0.4%, the alloy cost is rapidly increased, resulting in poor cost-effectiveness, and ductility of steel is rather reduced due to an excessive grain refinement effect and the solid solution strengthening effect. Therefore, in the present disclosure, the content of Mo is limited to 0.4% or less, and 0% is excluded in consideration of the amount unavoidably added in manufacturing. More preferably, the content of Mo is controlled to 0.3% or less.

Cr: 1% or Less (Excluding 0%)

Chromium (Cr) is a component added to improve hardenability of steel and ensure high strength. In addition, Cr is an element that plays a significantly important role in formation of martensite, and is advantageous in manufacturing complexed phase steel having high ductility by minimizing a decrease in elongation relative to an increase in strength. In particular, Cr forms Cr-based carbides such as $Cr_{23}C_6$ in a hot rolling process. Some of the carbides are dissolved and some of undissolved carbides remain in an annealing process. Accordingly, the amount of solid soluble C in martensite after cooling may be controlled to an appropriate level or lower, and thus generation of yield point elongation may be suppressed. Therefore, Cr is an element that is advantageous for manufacturing complexed phase steel having a low yield ratio. However, when the content of Cr exceeds 1%, the effect is saturated, and cold rolling properties are deteriorated due to an excessive increase in hot rolling strength, and a fraction of Cr-based carbides is increased and the Cr-based carbides coarsen, and thus the size of martensite coarsens after annealing, resulting in a decrease in elongation. Therefore, in the present disclosure, it is preferable to limit the content of Cr to 1% or less, and 0% is excluded in consideration of the amount unavoidably added in manufacturing. More preferably, the content of Cr is controlled to 0.6% or less.

P: 0.1% or Less (Excluding 0%)

Phosphorus (P) is a substitutional element having the greatest solid solution strengthening effect, and is an element that is advantageous in improving in-plane anisotropy and securing strength without significantly reducing formability. However, in a case where P is excessively added, the possibility of brittle fracture is greatly increased, such that P acts as an element that has the possibility of sheet rupture of a slab during hot rolling and deteriorates plating surface properties. Therefore, in the present disclosure, the content of P is limited to a maximum of 0.1%, and 0% is excluded in consideration of the amount unavoidably added in manufacturing.

S: 0.02% or Less (Excluding 0%)

Sulfur (S) is an element inevitably added as an impurity element in steel, and it is important to manage a content of S as low as possible because it is an element that reduces ductility and weldability. In particular, S has a problem of increasing the possibility of generating red brittleness. Therefore, it is preferable to control the content of S to 0.02% or less. However, 0% is excluded in consideration of an inevitably added level in a manufacturing process.

Sol.Al: 1.0% or Less (Excluding 0%)

Acid-soluble aluminum (sol.Al) is an element that is added for grain refinement and deoxidation in steel, and is a ferrite stabilizing element similar to Si. In addition, sol.Al is an effective component for improving martensite hardenability and forming retained austenite by distributing carbon in ferrite into austenite. In addition, sol.Al is a useful element that may improve ductility of the steel sheet by effectively suppressing precipitation of carbides in bainite when maintained in a bainite region during annealing. However, when a content of sol.Al exceeds 1.0%, it is advantageous to increase the strength due to the grain refinement effect, but inclusions are excessively formed during steelmaking casting process, such that defects on surface of a plated steel sheet are likely to occur, and the manufacturing cost is increased. Therefore, in the present disclosure, it is preferable to control the content of sol.Al to 1.0% or less.

Ti, Nb: 0.001 to 0.04% Each

Titanium (Ti) and niobium (Nb) are effective elements for increasing the strength of a steel sheet and refining grains by formation of nano-precipitates. When these elements are added, these elements combine with carbon to form significantly fine nano-precipitates. These nano-precipitates serve to reduce a difference in hardness between phases by strengthening a matrix structure. When a content of each of Ti and Nb is less than 0.001%, it is difficult to secure such an effect, and when the content of each of Ti and Nb exceeds 0.04%, the ductility may be significantly reduced due to excessive precipitates, along with an increase in manufacturing cost. Therefore, it is preferable to limit the content of each of Ti and Nb to 0.001 to 0.04%, and it is more preferable to control the content of each of Ti and Nb to a range of 0.005 to 0.02%.

N: 0.01% or Less (Excluding 0%)

Nitrogen (N) is a component that is effective in stabilizing austenite. When a content of N exceeds 0.01%, a steel refining cost is rapidly increased, and a risk of occurrence of cracks during casting is greatly increased due to AlN formation or the like. Therefore, it is preferable to limit an upper limit of the content of N to 0.01%. However, 0% is excluded in consideration of an inevitably added level.

B: 0.003% or Less

Boron (B) is a component that delays transformation of austenite into pearlite during cooling in annealing, and is a hardenable element that suppresses formation of ferrite and promotes formation of martensite. However, when a content of B exceeds 0.003%, excessive B is concentrated on the surface, which may cause a reduction in plating adhesion. Therefore, a content of B is controlled to 0.003% or less. More preferably, the content of B is controlled to 0.002% or less.

Sb: 0.05% or Less

Antimony (Sb) is distributed at grain boundaries to delay diffusion of oxidizing elements such as Mn, Si, and Al through the grain boundaries, such that Sb has an excellent effect in suppressing a surface concentration of oxides and suppressing coarsening of the surface concentrate depending on a temperature rise and a hot rolling process change. However, when a content of Sb exceeds 0.05%, the effect is saturated and the manufacturing cost and workability are reduced. Therefore, the content of Sb is limited to 0.05% or less. More preferably, the content of Sb is controlled to 0.03% or less.

In the present disclosure, it is preferable that the hot-dip galvanized steel sheet contains a balance of Fe and unavoidable impurities in addition to the above components.

Next, the hot-dip galvanized steel sheet of the present disclosure may improve workability and secure ductility by increasing a yield ratio compared to the existing DP steel. To this end, in addition to the alloy composition, it is required to satisfy the following base steel sheet microstructure and phase fraction control conditions. Hereinafter, a microstructure fraction and distribution and a component concentration in the microstructure will be described.

A microstructure of the hot-dip galvanized steel sheet of the present disclosure contains, by area %, 70% or more of a sum of bainite and tempered martensite, 10% or less of ferrite, and a balance of fresh martensite and retained austenite, and a fraction of the retained austenite is 5% or less in terms of area %. When the sum of bainite and tempered martensite is less than 70% or ferrite exceeds 10%, a desired yield ratio may not be secured. In addition, in order for retained austenite to exceed 5%, there occurs problems that the contents of Si and Al should be increased.

In the hot-dip galvanized steel sheet of the present disclosure, the components of C, Si, Al, Mn, Cr, Mo, and B among the base steel components in a matrix structure at a ¼t point of a thickness of a base steel sheet satisfy the following Relational Expression 1.

$$(4\times C+Si+Al)/(Mn+Cr+5\times Mo+200\times B)\leq 0.35. \quad \text{[Relational Expression 1]}$$

In the present disclosure, it is possible to manufacture a hot-dip galvanized steel sheet satisfying a relational expression YS×EL between yield strength (YS) and elongation (EL) of 9,000 or more and having a yield ratio (YS/TS) of 0.65 or more. To this end, it is important to control the components of C, Si, Al, Mn, Cr, Mo, and B among the base steel components in a matrix structure at a ¼t point of a thickness of a base steel sheet satisfy Relational Expression 1. Si and Al are ferrite stabilizing elements that contribute to formation of retained austenite and martensite by accelerating transformation of ferrite and promoting C enrichment in untransformed austenite. C is also an element that contributes to formation of martensite and fraction control through promotion of C enrichment in untransformed austenite. On the other hand, Mn, Cr, Mo, and B are elements that contribute to improving hardenability, but have a relatively low effect of contributing to C enrichment in austenite compared to C, Si, and Al. Therefore, it is important to properly control a ratio of C, Si, and Al and other hardenable elements Mn, Cr, Mo, and B.

When the value defined by Relational Expression 1 is 0.35 or less, as described above, the relational expression YS×EL between the yield strength (YS) and the elongation (EL) according to the yield ratio (YS/TS) of 9,000 or more may be secured, and furthermore, the fraction of bainite and tempered martensite of 70% or more may be secured, and the hole expansion ratio value of 30% or more may be secured by a reduction in difference in hardness between phases. On the other hand, when the value defined by Relational Expression 1 exceeds 0.35, the effect described above disappears.

In the complexed phase in which ferrite, bainite, martensite, and retained austenite are simultaneously formed as described above, the respective phases are finely and uniformly dispersed and at the same time the difference in hardness between phases is reduced, such that the yield ratio may be excellent compared to the DP steel according to the related art and thus workability and formability may be improved. In addition, the microstructural change has the effect of improving ductility by delaying formation, growth, and combination of voids that cause ductile fracture through relieving a concentration of local stress and strain after necking.

Through this, it is possible to provide a hot-dip galvanized steel sheet that has a hole expansion ratio (HER) of 30% or more, satisfies a relational expression YS×EL between yield strength (YS) and elongation (EL) of 9,000 or more, and has a yield ratio (YS/TS) of 0.65 or more.

Next, a method for manufacturing a hot-dip galvanized steel sheet having excellent ductility and formability of the present disclosure will be described.

In the present disclosure, in order to improve the yield ratio (YS/TS) compared to the DP steel according to the related art while satisfying a lean component system and high ductility as the properties of the DP steel, it is essential to control the structure and component and to perform a careful heat treatment. First, it is important to introduce a small amount of retained austenite. Retained austenite helps to improve the ductility of the steel sheet by causing transformation-induced plasticity. In order to introduce such retained austenite, after cooling is performed to a temperature of Ms or lower during quenching to partially form martensite, and immediately, reheating is performed to a temperature of Ms or higher to undergo a partitioning process. At this time, a large amount of bainite is formed, and C is stably distributed, which contributes to formation of retained austenite in a final structure. In addition, bainite has an effect of reducing the difference in hardness between phases of ferrite and martensite. In order to secure additional ductility, a process of partially forming ferrite is also important. The fraction of ferrite may be controlled to 10% or less through single-phase annealing or directly below single-phase annealing, and a small amount of additional ferrite may be formed in a slow cooling section. Through this, improvement of additional ductility is achieved. In addition, fine nano-precipitates are precipitated in ferrite, such that the difference in hardness between phases may be additionally reduced, and the workability may be improved. Finally, a small amount of fresh martensite is introduced at the time of final cooling, such that desired strength may be secured.

To this end, a method for manufacturing a hot-dip galvanized steel sheet of the present disclosure includes: preparing a steel slab satisfying the composition component and Relational Expression 1 and then reheating the steel slab; subjecting the reheated slab to hot rolling so that a finish rolling end temperature is Ar3 to Ar3+50° C., coiling the hot-rolled steel sheet at 400 to 650° C., and then cooling the coiled hot-rolled steel sheet to room temperature at an average cooling rate of 0.1° C. or lower; subjecting the cooled hot-rolled steel sheet to cold rolling at a reduction ratio of 40 to 70% to manufacture a cold-rolled steel sheet; continuously annealing the cold-rolled steel sheet at a temperature of 820 to 860° C.; primarily cooling the continuously annealed steel sheet to a temperature within a range of 630 to 680° C. at an average cooling rate of 10° C. or lower, secondarily cooling the primarily cooled steel sheet to a temperature of 300 to 350° C. at an average cooling rate of 5° C. or higher using hydrogen gas, reheating the secondarily cooled steel sheet to a temperature of 400 to 480° C., and then maintaining the reheated steel sheet for 60 seconds or longer; and subjecting the maintained steel sheet to hot-dip galvanizing at a temperature of 400 to 450° C. and then cooling the hot-dip galvanized steel sheet to a temperature of Ms to 100° C. or lower at an average cooling rate of 5° C. or higher.

First, a steel slab having the composition component is prepared, and the steel slab is reheated. The slab reheating process is a process of heating a steel slab in order to smoothly perform a subsequent rolling process and to sufficiently obtain target physical properties of the steel sheet. The present disclosure is not particularly limited to such reheating conditions, and normal reheating conditions are sufficient. As an example, the reheating is performed in a temperature within a range of 1,100 to 1,300° C.

Subsequently, in the present disclosure, the reheated steel slab is subjected to finish hot rolling so that a finish rolling end temperature is Ar3 to Ar3+50° C. The present disclosure is not limited to specific hot rolling conditions at this time, and a normal hot rolling temperature may be used.

Thereafter, in the present disclosure, the finish hot-rolled steel sheet is coiled in a temperature within a range of 400 to 650° C., and then the coiled hot-rolled steel sheet is cooled to room temperature at an average cooling rate of ° C. or lower, such that a hot-rolled steel sheet in which carbides serving as austenite nucleation sites are finely dispersed is manufactured. The fine carbides are uniformly dispersed by the hot rolling process, such that the carbides are dissolved during annealing and austenite is finely dispersed. As a result, fine martensite may be uniformly dispersed after annealing.

In addition, in the present disclosure, the cooled hot-rolled steel sheet is subjected to cold rolling at a reduction ratio of 40 to 70% to manufacture a cold-rolled steel sheet.

The coiled hot-rolled steel sheet is subjected to pickling, and then cold rolling is performed at a reduction ratio of 40 to 70%. When the cold rolling reduction ratio is less than 40%, it is difficult to secure a desired thickness, and it is difficult to correct the shape of the steel sheet. On the other hand, when the cold rolling reduction ratio exceeds 70%, cracks at an edge portion of the steel sheet are likely to occur, and a cold rolling load may be generated. Therefore, in the present disclosure, it is preferable to limit the cold rolling reduction ratio to 40 to 70%.

Subsequently, in the present disclosure, the cold-rolled steel sheet is continuously annealed in a temperature within a range of 820 to 860° C. Such a continuous annealing process is performed to cause recrystallization, to form ferrite and austenite, and to distribute carbon. When the continuous annealing temperature is lower than 820° C., it is difficult to obtain a sufficient fraction of austenite, such that a desired fraction of martensite, bainite, and retained austenite may not be secured after annealing. On the other hand, when the continuous annealing temperature exceeds 860° C., since the productivity is reduced and excessive austenite is formed, and a fraction of bainite and martensite is significantly increased after cooling, the yield strength is increased, and the ductility is reduced, such that it is difficult to secure high ductility properties. In addition, surface enrichment by elements that reduce wettability of hot-dip galvanizing, such as Si, Mn, and B, may be severe, which may cause deterioration in the plating surface quality.

In addition, in the present disclosure, the continuously annealed steel sheet is primarily cooled to a temperature within a range of 630 to 680° C. at an average cooling rate of 10° C. or lower, the primarily cooled steel sheet is secondarily cooled to a temperature of 300 to 350° C. at an average cooling rate of 5° C. or higher using hydrogen gas, the secondarily cooled steel sheet is reheated to a temperature of 400 to 480° C., and then the reheated steel sheet is maintained for 60 seconds or longer.

The continuously annealed steel sheet is primarily cooled to a temperature within a range of 630 to 680° C. at an average cooling rate of 10° C. or lower, the primarily cooled steel sheet is secondarily cooled to a temperature within a range of 300 to 360° C. at an average cooling rate of 5° C./s or more using a hydrogen quenching facility using hydrogen gas, and then fresh martensite is partially introduced. Then, the secondarily cooled steel sheet is immediately reheated to a temperature of 400 to 480° C. and then maintained for 60 seconds or longer to form bainite and to enrich carbon in surrounding untransformed austenite.

In this case, it is significantly important to control the quenching temperature during the secondary cooling to 300 to 360° C., which is lower than the martensite forming temperature Ms. When the quenching temperature exceeds 360° C., since a fraction of initially formed martensite is significantly low or it is difficult to form martensite, carbon partitioning does not occur smoothly, such that it is difficult to form a desired fraction of retained austenite during final cooling. On the other hand, when the quenching temperature is lower than 300° C., the shape of the sheet may be deteriorated and the facility load may be generated.

In addition, it is important to control the reheating temperature to 400 to 480° C., which is higher than the temperature Ms. When the reheating temperature is lower than 400° C., bainite is not quickly formed, such that the carbon partitioning does not occur smoothly, and when the reheating temperature exceeds 480° C., less bainite is also formed, such that a fraction of fresh martensite is increased during final cooling. That is, it is important to carefully control the secondary quenching temperature and the reheating temperature during Q&P annealing so as to form a desired microstructure.

Subsequently, in the present disclosure, the maintained steel sheet is subjected to hot-dip galvanizing at a temperature of 400 to 450° C., and then the hot-dip galvanized steel sheet is cooled to a temperature of Ms to 100° C. or lower at an average cooling rate of 5° C. or higher, such that it is possible to manufacture a final product in which fresh martensite is formed in adjacent to bainite. In this case, skin pass may be performed at a reduction ratio of lower than 1%, if necessary.

In addition, in the present disclosure, the method for manufacturing a hot-dip galvanized steel sheet may further include subjecting the manufactured hot-dip galvanized steel sheet to an alloying heat treatment.

MODE FOR INVENTION

Hereinafter, the present disclosure will be described with reference to Examples.

EXAMPLES

Steel slabs having the compositions as shown in Table 1 were prepared. In addition, the steel slabs were reheated to a temperature range to 1,050 to 1,250° C., and then the reheated steel slabs were subjected to finish hot rolling at a temperature of 950° C. in a range of Ar3 to Ar3+50° C. The hot-rolled steel sheets were coiled at 400 to 650° C., and then the coiled hot-rolled steel sheets were cooled at a cooling rate of 0.1° C. or lower per second, thereby manufacturing hot-rolled steel sheets. The hot-rolled steel sheets were pickled, and then the pickled hot-rolled steel sheets were subjected to cold rolling at a reduction ratio of 40 to 70%. Thereafter, the cold-rolled steel sheets were continuously annealed at the temperature shown in Table 2, and then the continuously annealed cold-rolled steel sheets were subjected to a Q&P heat treatment under the conditions as shown in Table 2. The QP heat-treated cold-rolled steel sheets were hot-dip galvanized and then subjected to an alloying heat treatment, the hot-dip galvanized steel sheets were finally cooled to introduce fresh martensite and retained austenite, and then the cooled hot-dip galvanized steel sheets were subjected to skin pass at less than 1%, thereby manufacturing hot-dip galvanized steel sheets.

The microstructure and mechanical properties of each of the steel sheets manufactured as described above were evaluated. The results thereof are shown in Table 3. At this time, a tensile test on each test piece was conducted in an L direction using the ASTM standard to evaluate tensile properties (tensile strength (TS), yield strength (YS), and elongation (El)). In addition, a matrix structure was analyzed at a ¼t point of the sheet thickness of the annealed steel sheet, and the result thereof was used as a microstructure fraction. Specifically, after initial corrosion, the fractions of ferrite, bainite, fresh martensite, and austenite were measured using FE-SEM and an image analyzer. In addition, a hole expansion ratio was measured using a hole expansion ratio tester.

TABLE 1

| | Composition component (wt %) | | | | | | | | | | | | Relational Expression |
|---|---|---|---|---|---|---|---|---|---|---|---|---|---|
| Classification | C | Si | Mn | P | S | S•Al | Nb | Ti | B | Cr | Mo | Sb | 1 |
| Inventive Steel 1 | 0.12 | 0.6 | 2.4 | 0.01 | 0.001 | 0.025 | 0.02 | 0.015 | — | 0.2 | 0.4 | 0.02 | 0.240 |
| Inventive Steel 2 | 0.13 | 0.6 | 2.6 | 0.012 | 0.002 | 0.04 | 0.02 | 0.02 | — | 0.2 | 0.15 | 0.02 | 0.332 |

TABLE 1-continued

| Classification | Composition component (wt %) | | | | | | | | | | | | Relational Expression |
|---|---|---|---|---|---|---|---|---|---|---|---|---|---|
| | C | Si | Mn | P | S | S•Al | Nb | Ti | B | Cr | Mo | Sb | 1 |
| Inventive Steel 3 | 0.11 | 0.6 | 2.6 | 0.01 | 0.001 | 0.025 | 0.02 | 0.015 | — | 0.5 | 0.2 | 0.03 | 0.260 |
| Inventive Steel 4 | 0.12 | 0.8 | 2.4 | 0.01 | 0.001 | 0.025 | 0.02 | 0.015 | — | 0.5 | 0.2 | 0.03 | 0.335 |
| Inventive Steel 5 | 0.14 | 0.6 | 2.3 | 0.012 | 0.002 | 0.047 | 0.02 | 0.04 | 0.0018 | 0.2 | 0.2 | 0.02 | 0.308 |
| Inventive Steel 6 | 0.07 | 0.6 | 2.3 | 0.02 | 0.002 | 0.035 | 0.05 | 0.02 | 0.0025 | 0.9 | 0.12 | 0.02 | 0.215 |
| Comparative Steel 1 | 0.12 | 0.6 | 2.3 | 0.01 | 0.002 | 0.5 | — | — | — | 1 | 0.1 | 0.02 | 0.416 |
| Comparative Steel 2 | 0.13 | 0.6 | 2.3 | 0.012 | 0.002 | 0.054 | 0.02 | 0.04 | 0.0019 | 0.2 | 0.06 | 0.02 | 0.378 |
| Comparative Steel 3 | 0.14 | 0.6 | 2.2 | 0.01 | 0.002 | 0.5 | — | — | — | 1 | 0.1 | 0.03 | 0.449 |
| Comparative Steel 4 | 0.1 | 0.5 | 2.4 | 0.01 | 0.002 | 0.5 | — | — | — | 1 | 0.1 | 0.02 | 0.359 |
| Comparative Steel 5 | 0.14 | 0.6 | 2.6 | 0.012 | 0.001 | 0.021 | 0.02 | 0.02 | — | 0.2 | — | 0.01 | 0.422 |
| Comparative Steel 6 | 0.14 | 0.6 | 2.4 | 0.01 | 0.002 | 0.035 | 0.02 | 0.02 | — | 0.2 | 0.1 | 0.02 | 0.385 |

* In the steel sheet compositions of Table 1, N is contained as an impurity element within the range of 30 to 50 ppm

TABLE 2

| Classification | Annealing Temperature (° C.) | Primary cooling | | Secondary cooling | | Reheating | | Reference |
|---|---|---|---|---|---|---|---|---|
| | | Cooling Temperature (° C.) | Cooling rate (° C./s) | Cooling Temperature (° C.) | Cooling rate (° C./s) | Temperature (° C.) | Maintaining time (sec) | |
| Inventive Steel 1 | 831 | 651 | 5.67 | 300 | 25.55 | 442 | 45 | Inventive Example 1 |
| | 830 | 650 | 5.67 | 254 | 28.82 | 440 | 45 | Comparative Example 1 |
| | 835 | 638 | 6.21 | 410 | 16.59 | 440 | 45 | Comparative Example 2 |
| Inventive Steel 2 | 840 | 652 | 5.92 | 320 | 24.16 | 432 | 45 | Inventive Example 2 |
| | 840 | 646 | 6.11 | 322 | 23.58 | 350 | 45 | Comparative Example 3 |
| | 838 | 636 | 6.36 | 320 | 23.00 | 518 | 45 | Comparative Example 4 |
| Inventive Steel 3 | 814 | 660 | 4.85 | 344 | 23.00 | 460 | 45 | Inventive Example 3 |
| Inventive Steel 4 | 828 | 651 | 5.58 | 331 | 23.29 | 460 | 45 | Inventive Example 4 |
| Inventive Steel 5 | 830 | 657 | 5.45 | 320 | 24.53 | 480 | 45 | Inventive Example 5 |
| Inventive Steel 6 | 845 | 649 | 6.18 | 360 | 21.03 | 480 | 45 | Inventive Example 6 |
| Comparative Steel 1 | 816 | 621 | 6.14 | 300 | 23.36 | 460 | 45 | Comparative Example 5 |
| Comparative Steel 2 | 810 | 653 | 4.95 | 450 | 14.77 | 480 | 45 | Comparative Example 6 |
| Comparative Steel 3 | 842 | 650 | 6.05 | 350 | 19.65 | 460 | 45 | Comparative Example 7 |
| Comparative Steel 4 | 851 | 651 | 6.30 | 450 | 14.63 | 460 | 45 | Comparative Example 8 |
| Comparative Steel 5 | 830 | 646 | 5.80 | 350 | 21.54 | 480 | 45 | Comparative Example 9 |
| Comparative Steel 6 | 854 | 670 | 5.80 | 350 | 23.29 | 460 | 45 | Comparative Example 10 |

TABLE 3

| Classification | Mechanical properties YS (MPa) | TS (MPa) | E1(%) | YR | YS × E1 | HER(%) | Phase fraction (area %) F | B + TM | FM | RA | Reference |
|---|---|---|---|---|---|---|---|---|---|---|---|
| Inventive Steel 1 | 958 | 1090 | 12.1 | 0.88 | 11560 | 43 | 7 | 79 | 11 | 3 | Inventive Example 1 |
| | 970 | 1080 | 9.4 | 0.90 | 9118 | 55 | 5 | 84 | 5 | 6 | Comparative Example 1 |
| | 701 | 1108 | 13.1 | 0.63 | 9183 | 33 | 4 | 58 | 37 | 1 | Comparative Example 2 |
| Inventive Steel 2 | 901 | 1112 | 12.0 | 0.81 | 10812 | 40 | 3 | 72 | 22 | 3 | Inventive Example 2 |
| | 941 | 970 | 11.0 | 0.97 | 10351 | 59 | 2 | 97 | 0 | 1 | Comparative Example 3 |
| | 645 | 1079 | 10.7 | 0.60 | 6902 | 32 | 6 | 66 | 27 | 1 | Comparative Example 4 |
| Inventive Steel 3 | 892 | 1103 | 12.7 | 0.81 | 11302 | 50 | 8 | 74 | 16 | 2 | Inventive Example 3 |
| Inventive Steel 4 | 882 | 1071 | 11.8 | 0.82 | 10428 | 47 | 7 | 78 | 12 | 3 | Inventive Example 4 |
| Inventive Steel 5 | 863 | 1118 | 12.1 | 0.77 | 10442 | 38 | 8 | 81 | 9 | 2 | Inventive Example 5 |
| Inventive Steel 6 | 801 | 1065 | 11.5 | 0.75 | 9212 | 36 | 4 | 73 | 19 | 4 | Inventive Example 6 |
| Comparative Steel 1 | 519 | 930 | 15.1 | 0.56 | 7853 | 25 | 42 | 28 | 29 | 1 | Comparative Example 5 |
| Comparative Steel 2 | 519 | 1040 | 12.5 | 0.50 | 6488 | 22 | 33 | 30 | 37 | 0 | Comparative Example 6 |
| Comparative Steel 3 | 517 | 1046 | 12.9 | 0.49 | 6670 | 21 | 38 | 27 | 33 | 2 | Comparative Example 7 |
| Comparative Steel 4 | 516 | 987 | 14.2 | 0.52 | 7306 | 20 | 36 | 35 | 29 | 0 | Comparative Example 8 |
| Comparative Steel 5 | 579 | 960 | 14.5 | 0.60 | 8396 | 27 | 4 | 41 | 33 | 2 | Comparative Example 9 |
| Comparative Steel 6 | 564 | 970 | 15.6 | 0.59 | 8794 | 25 | 24 | 38 | 37 | 1 | Comparative Example 10 |

In Table 3, F represents ferrite, B represents bainite, TM represents tempered martensite, FM represents fresh martensite, and RA represents retained austenite As shown in Tables 1 to 3, in the cases of Inventive Examples 1 to 6 in which the steel composition component and manufacturing process conditions satisfied the requirements of the present disclosure, it could be seen that the relational expression YS×EL between the yield strength (YS) and the elongation was 9,000 or more, and the yield ratio (YS/TS) was 0.65 or more, which showed that the material and the workability of the steel sheet targeted in the present disclosure were secured.

On the other hand, in the cases of Comparative Examples 1 to 10 in which the steel composition component and manufacturing process conditions were out of the ranges of the present disclosure or the microstructure fraction and occupancy ratio in steel were out of the ranges of the present disclosure, it could be seen that the relational expression YS×EL between the yield strength (YS) and the elongation was less than 9,000, or the yield ratio (YS/TS) was less than 0.65. Therefore, the strength, ductility, workability, and weldability of the steel sheet targeted in the present disclosure were not simultaneously secured.

Specifically, in Comparative Example 1, the steel composition component was within the range of the present disclosure, but the secondary cooling temperature was too low, such that the fraction of retained austenite exceeded 5%, and a facility load was generated due to an excessive cooling rate.

In Comparative Example 2, the steel composition component was within the range of the present disclosure, but the secondary cooling temperature was too high, such that tempered martensite was not sufficiently formed, and at the same time, carbon partitioning did not occur, and as a result, a desired yield ratio was not obtained.

In Comparative Example 3, the steel composition component was within the range of the present disclosure, but the reheating temperature was too low, such that tempered martensite was excessively formed, and as a result a desired strength was not obtained. In Comparative Example 4, the reheating temperature was too high, such that a fraction of bainite was decreased, and a fraction of fresh martensite was increased, and as a result a desired yield ratio was not obtained.

Comparative Examples 5 to 10 were the cases in which all of the steel composition component and manufacturing process conditions were out of the ranges of the present disclosure. Specifically, in Comparative Examples 5 and 6, the steel composition component was out of the range of the present disclosure, and the continuous annealing temperature and the reheating temperature were out of the ranges of the present disclosure, such that ferrite was excessively formed, and thus, a desired yield ratio was not obtained. In addition, in Comparative Examples 7 and 8, the steel composition component was out of the range of the present disclosure, and the secondary cooling temperature and the reheating temperature were too high, such that a desired yield ratio was not obtained. In Comparative Examples 9 and the reheating temperature was too high, such that a desired yield ratio was not obtained.

Figure 2:
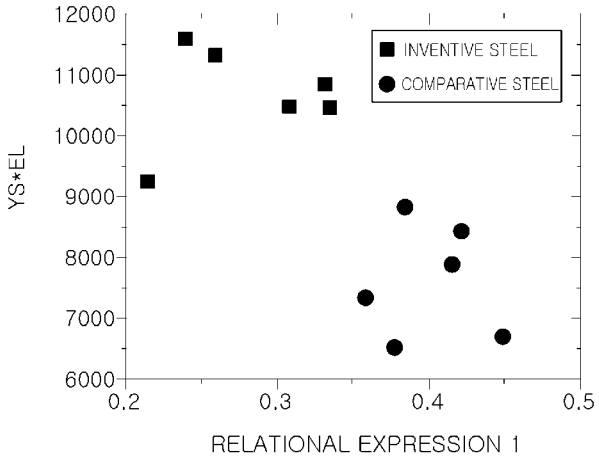
FIG. 2 is a view illustrating a change in relational expression YS×EL between yield strength (YS) and elongation (EL) according to Relational Expression 1 in an exemplary embodiment in the present disclosure.
Figure 3:
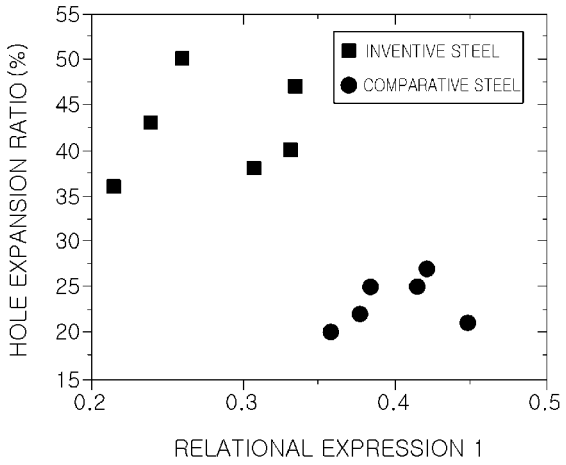
FIG. 3 is a view illustrating a change in hole expansion ratio value according to Relational Expression 1 in an exemplary embodiment in the present disclosure.

Meanwhile, FIG. 1 is a view illustrating a change in relational expression YS×EL between the yield strength (YS) and the elongation (EL) according to the yield ratio (YS/TS) in Examples (Inventive Steels 1 to 6 and Comparative Steels 5 to 10) of the present disclosure, FIG. 2 is a view illustrating a change in relational expression YS×EL between the yield strength (YS) and the elongation (EL) according to Relational Expression 1 (Inventive Steels 1 to 6 and Comparative Steels 5 to 10) of the present disclosure, and FIG. 3 is a view illustrating a change in hole expansion ratio value according to Relational Expression 1 in Examples (Inventive Steels 1 to 6 and Comparative Steels 5 to 10) of the present disclosure. Meanwhile, in FIGS. 1 to 3, Inventive Steels 1 to 6 represent the inventive steels corresponding to Inventive Examples 1 to 6, respectively.

As described above, the preferred exemplary embodiments in the present disclosure have been described in the detailed description of the present disclosure, but the exemplary embodiments may be variously modified by those skilled in the art to which the present disclosure pertains without departing from the scope of the present disclosure. Therefore, the scope of the present disclosure is not construed as being limited to the exemplary embodiments described above, but should be defined by the following claims as well as equivalents thereto.

The invention claimed is:

1. A hot-dip galvanized steel sheet having excellent ductility and formability, the steel sheet comprising, by wt %, 0.06 to 0.16% of carbon (C), 0.8% or less (excluding 0%) of silicon (Si), 2.1 to 2.7% of manganese (Mn), 0.4% or less (excluding 0%) of molybdenum (Mo), 1% or less (excluding 0%) of chromium (Cr), 0.1% or less (excluding 0%) of phosphorus (P), 0.02% or less of sulfur(S), 1% or less (excluding 0%) of aluminum (sol.Al), 0.001 to 0.04% of titanium (Ti), 0.001 to 0.04% of niobium (Nb), 0.01% or less (excluding 0%) of nitrogen (N), 0.01% or less of boron (B), 0.05% or less of antimony (Sb), and a balance of Fe and unavoidable impurities, wherein the components of C, Si, Al, Mn, Cr, Mo, and B in a matrix structure at a ¼t point of a thickness of the steel sheet satisfy the following Relational Expression 1, a microstructure in the steel sheet contains, by area %, 70% or more of a sum of bainite and tempered martensite, 10% or less of ferrite, 5% or less of retained austenite, and a balance of fresh martensite, and the steel sheet has a hole expansion ratio (HER) of 30% or more, satisfies a relational expression YS x EL between yield strength (YS) and elongation (EL) of 9,000 or more, and has a yield ratio (YS/TS) of 0.65 or more where TS is a tensile strength, $$(4\times C+Si+Al)/(Mn+Cr+5\times Mo+200\times B)\leq 0.35. \quad \text{[Relational Expression 1]}$$

2. A method for manufacturing a hot-dip galvanized steel sheet having excellent ductility and formability, the method comprising:

preparing a steel slab containing, by wt %, 0.06 to 0.16% of carbon (C), 0.8% or less (excluding 0%) of silicon (Si), 2.1 to 2.7% of manganese (Mn), 0.4% or less (excluding 0%) of molybdenum (Mo), 1% or less (excluding 0%) of chromium (Cr), 0.1% or less (excluding 0%) of phosphorus (P), 0.02% or less of sulfur(S), 1% or less (excluding 0%) of aluminum (sol.Al), 0.001 to 0.04% of titanium (Ti), 0.001 to 0.04% of niobium (Nb), 0.01% or less (excluding 0%) of nitrogen (N), 0.01% or less of boron (B), 0.05% or less of antimony (Sb), and a balance of Fe and unavoidable impurities, and satisfying the following Relational Expression 1, reheating the steel slab;

hot rolling the reheated steel slab to manufacture a hot-rolled steel sheet, wherein a finish rolling end temperature is Ar3 to Ar3+50° C.;

coiling the hot-rolled steel sheet at 400 to 650° C.;

cooling the coiled hot-rolled steel sheet to room temperature at an average cooling rate of 0.1° C./s or lower;

cold rolling the cooled hot-rolled steel sheet at a reduction ratio of 40 to 70% to manufacture a cold-rolled steel sheet;

continuously annealing the cold-rolled steel sheet at a temperature of 820 to 860° C.;

primarily cooling the continuously annealed steel sheet to a temperature within a range of 630 to 680° C. at an average cooling rate of 10° C./s or lower;

secondarily cooling the primarily cooled steel sheet to a temperature of 300 to 350° C. at an average cooling rate of 5° C./s or higher using hydrogen gas;

reheating the secondarily cooled steel sheet to a temperature of 400 to 480° C., and then maintaining the reheated steel sheet for 60 seconds or longer; and hot-dip galvanizing the maintained steel sheet at a temperature of 400 to 450° C. and then cooling the hot-dip galvanized steel sheet to a temperature of Ms to 100° C. or lower at an average cooling rate of 5° C./s or higher, $$(4\times C+Si+Al)/(Mn+Cr+5\times Mo+200\times B)\leq 0.35. \quad \text{[Relational Expression 1]}$$

3. The method of claim 2, wherein the hot-dip galvanized steel sheet includes a microstructure comprising, by area %, 70% or more of a sum of bainite and tempered martensite, 10% or less of ferrite, 5% or less of retained austenite, and a balance of fresh martensite and retained austenite.

4. The method of claim 2, further comprising subjecting the manufactured hot-dip galvanized steel sheet to an alloying heat treatment.

5. The method of claim 2, wherein the hot-dip galvanized steel sheet is subjected to a skin pass at a reduction ratio of less than 1%.

* * * * *